US006875043B2

(12) United States Patent
Turek et al.

(10) Patent No.: US 6,875,043 B2
(45) Date of Patent: Apr. 5, 2005

(54) ELECTRICAL COMPONENT TERMINAL CONNECTOR

(75) Inventors: James Turek, LaGrange, IL (US); Kenneth Irish, Chicago, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 30 days.

(21) Appl. No.: 10/092,078

(22) Filed: Mar. 6, 2002

(65) Prior Publication Data

US 2003/0171023 A1 Sep. 11, 2003

(51) Int. Cl.[7] ..... H01R 11/20
(52) U.S. Cl. ..... 439/397
(58) Field of Search ..... 439/397, 395, 439/471, 400, 417, 402, 403, 404, 412, 610

(56) References Cited

U.S. PATENT DOCUMENTS

| | | | | | |
|---|---|---|---|---|---|
| 4,214,361 | A | * | 7/1980 | Coldren et al. | 29/863 |
| 4,404,744 | A | * | 9/1983 | Stenz et al. | 29/883 |
| 4,541,174 | A | * | 9/1985 | Liburdi | 29/883 |
| 5,571,034 | A | * | 11/1996 | Seidler | 439/876 |
| 6,299,475 | B1 | * | 10/2001 | Huspeni et al. | 439/412 |

OTHER PUBLICATIONS

Alexander, Jr., US Reg. No.: H379, Strain Relief and Ground Connector for Shielded Cable, Dec. 1, 1987.*

* cited by examiner

*Primary Examiner*—Phuong Dinh
(74) *Attorney, Agent, or Firm*—Mark W. Croll, Esq.; Paul F. Donovan, Esq.; Welsh & Katz, Ltd.

(57) ABSTRACT

A connector for connecting an electrical component having a tab-type electrical terminal to a conductor or wire includes a non-conducting housing base having a bottom wall, an upstanding front wall and upstanding, opposing side walls generally transverse to the front wall. The base defines a well. The front wall has a notch formed therein for receiving the conductor and the bottom wall has an opening for receiving the tab-type electrical terminal. A conductive contact is carried by the base, disposed in the well. The contact has conductor receiving elements generally aligned with and on opposing sides of the base front wall notch. The conductor receiving elements are configured to receive the conductor therebetween. The contact also includes first and second terminal engaging portions that define a tab-receiving region. The contact is carried by the base to dispose the tab-receiving region in overlying relation to the housing base bottom wall opening. The tab-type terminal is inserted through the housing base bottom wall opening and is received in the contact tab-receiving region. The terminal is in electrical contact with the conductor positioned between the conductor receiving elements. A plurality of housing bases disposed on a carrier strip and a plurality of contacts disposed on a carrier strip are disclosed, as is a method for making the connectors.

15 Claims, 5 Drawing Sheets

ELECTRICAL COMPONENT TERMINAL CONNECTOR

BACKGROUND OF THE INVENTION

The present invention is directed to electrical component terminal connectors. More particularly, the present invention is directed to electrical terminal connectors that have a housing and a contact for use with tab-type terminal connections, such as those found on small or miniaturized electrical motors and like electrical components.

Typically, small or miniaturized electrical components such as motors have tabs or terminals extending from the motor housing that serve as terminations or connections for providing electrical power to the motor. These tabs are quite small and are typically sized as 0.080 or 0.110 inch tabs. That is, the dimension across the width of the each tab is about 0.080 inches or about 0.110 inches. The widths, as well as the thickness of these tabs does, however, vary depending upon, for example, the equipment manufacturer, the specific equipment or other factors.

The tabs are often formed having a small hole or opening for receiving an electrical wire. The wire is threaded through the opening and is typically soldered to the tab.

These soldering operations, particularly given the small size of the tabs, can be quite time consuming. In addition, because of the small size of the tabs, misapplication or improper soldering can readily occur. Moreover, subsequent to soldering, the posts or terminals must be cleaned to assure proper electrical connection between the terminals and the wires. Last, in order to conduct maintenance or to replace to electrical component, the soldered termination be unsoldered or loosened, which is often difficult.

Other methods for terminating these components include crimp, fast-on terminals. However, like soldering, these fast-on terminals are difficult to loosen or disconnect from the component terminal and can result in damage to the terminals or tabs. Moreover, because of the stresses exerted on the terminals during connection and disconnection, the number of mate/unmate cycles is quite limited before terminal degradation.

As a result, it has been found that known termination methods for these motors are quite inefficient and labor intensive. Additionally, these known termination methods can reduce the life of the electrical component due to terminal (tab) degradation.

Accordingly, there exists a need for a connector that readily attaches to known electrical component terminals (tabs), for example, on motors. Desirably, such a connector readily attaches to the electrical tab without the need for soldering or other fusing processes. Most desirably, such a connector reduces the stresses on the component terminals, can be fitted with a wire for readily providing electrical termination, and permits multiple mate/unmate cycles.

BRIEF SUMMARY OF THE INVENTION

A connector for connecting an electrical component having a tab-type electrical terminal to a conductor, such as a wire, includes a housing and a contact. The contact is positioned within the housing.

The housing is non-conducting and includes a base having a bottom wall, an upstanding front wall and upstanding, opposing side walls generally transverse to the front wall. The base defines a well. The front wall has a notch formed therein for receiving the conductor and the bottom wall has an opening for receiving the tab-type electrical terminal.

The contact is conductive and is carried by the housing base, disposed in the well. The contact has conductor receiving elements generally aligned with, and on opposing sides of the notch in the housing front wall. The conductor receiving elements are configured for receiving the conductor therebetween.

The contact further includes first and second terminal engaging portions that define a tab-receiving region. In a present embodiment, the tab-receiving region is defined by a biased spring leg and a side wall of the contact. A gap is defined between the spring leg and the side wall of the contact.

The contact is positioned and secured in the housing base to dispose the tab-receiving region in overlying relation to the housing base bottom wall opening. That is, the gap between the spring leg and the contact side wall overlie, in part, the opening in the housing base bottom wall. Thus, when the terminal is inserted through the housing base bottom wall opening, it is received in the contact tab-receiving region, and is in electrical contact with the conductor positioned between the conductor receiving elements.

In one embodiment, the connector includes a cover configured to fit onto the housing base. The cover and housing base are configured for fitting onto one another in a first opened position (for receiving the conductor) and a second closed position for locking the conductor in the connector (electrically connected to the contact).

The cover can be configured to receive the conductor in the opened position and to urge the conductor between the conductor receiving elements in the closed position. To effect this locking, the cover includes an anvil portion for urging the conductor between the conductor receiving elements when the cover is in the second position.

Alternately, a coverless connector can include a housing base front wall having retaining fingers disposed on opposing sides of the notch. The retaining fingers retain the conductor in the connector when the conductor is positioned between the conductor receiving elements.

A method for making the connectors includes the steps of forming a plurality of connector housing bases on a housing base carrier. Each connector housing base is formed a first predetermined distance from each of its adjacent housing bases. A plurality of contacts are formed on a contact carrier. Each contact is formed a second predetermined distance from each of its adjacent contacts.

A first contact is aligned with a first housing base and the contact is secured in the housing base with which it is aligned. The method can include indexing the housing base carrier and indexing the contact carrier to align a second contact with a second housing base and securing the second contact in the second housing base with which it is aligned.

The method can include providing a connecting region on a first housing base carrier and connecting the first housing base carrier with a second housing base carrier to form an elongated strip.

The method can further include of forming a plurality of connector housing covers on a cover base carrier, aligning a first of the plurality of connector housing covers with a first of the plurality of housing bases, and securing the first of the plurality of housing covers to the first of the housing bases with which it is aligned.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
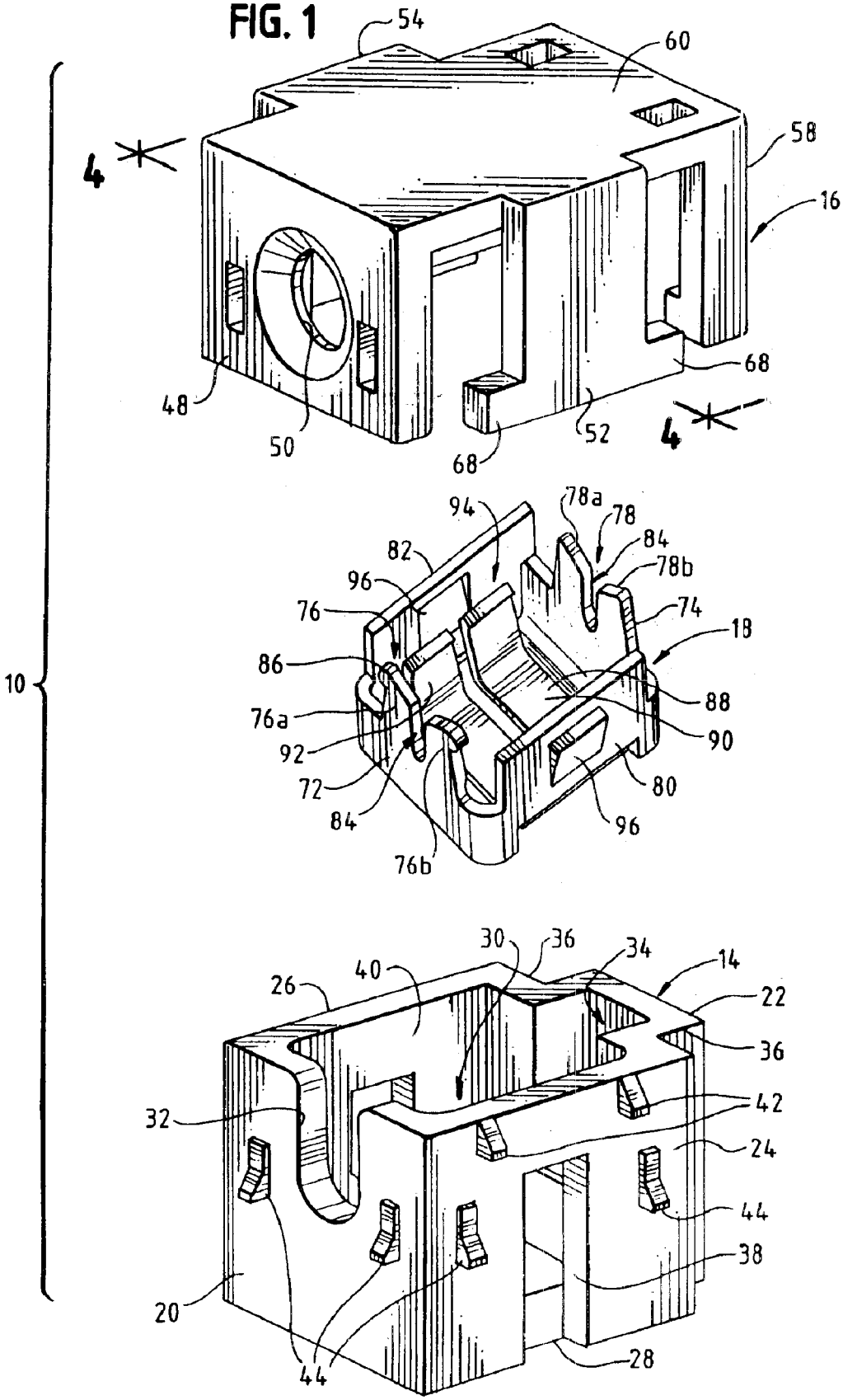
FIG. 1 illustrates an exploded perspective view of one embodiment of electrical tab connector in accordance with the principles of the present invention, this embodiment showing a two-piece housing (cover and base) and an electrical contact for positioning within the base.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent and Trademark Office, and does not imply, nor should be inferred to limit the subject matter disclosed herein.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

Figure 11:
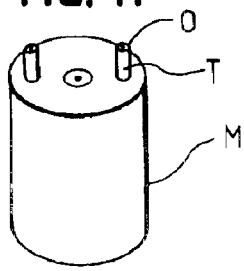
FIG. 11 is a perspective view of a motor having tab-type terminals extending form the motor body.

Referring now to the figures and in particular to FIG. 1 there is shown one embodiment of an electrical terminal or tab connector 10 in accordance with the principles of the present invention. The connector 10 is configured for use with an electrical component, such as the exemplary motor M (FIG. 11) having tab-type electrical terminal connectors T. The connector 10 includes generally a housing 12 have a base 14 and a cover 16, and an electrical contact 18. The electrical contact 18 is positioned and secured within the base 14 of the housing 12.

Those skilled in the art will recognize that the electrical contact 18 is to be formed from an electrically conductive material (typically a metal) and that the housing 12 is preferably formed from an electrically non-conductive material, such as plastic or the like. In a preferred embodiment, as will be discussed below, the housing 12 is formed from a readily formable plastic or polymeric material in, for example, known injection molding techniques.

The housing base 14, as best seen in FIG. 1, includes a front wall 20, a rear wall 22, a pair of opposing side walls 24, 26 and a bottom wall 28. The base 14 defines a well as indicated at 30, in which the contact 18 is received.

The front wall 20 includes a notch or channel 32 formed therein extending downwardly from an upper edge. The notch 32 is configured for receipt of a conductor such as a wire W. The rear wall 22 includes a rear channel 34 that, as will be discussed below, is configured to cooperate with a portion of the cover 16 to assure a tight and secure connection of the wire W to the contact 18. The rear channel 34 is defined by stepped channel walls 36, 38 at the juncture of the rear wall 22 and the side walls 24, 26.

One of the sidewalls 24 includes an open slotted region 38 that extends upwardly from the bottom wall 28. The other sidewall 26 includes a channel 40 (corresponding to the slotted region 38) that extends upwardly from the bottom wall 28. The slotted region 38 and the channel 40 terminate below the upper edges of the side walls 24, 26 and are configured to permit locking the contact 18 into the housing base 14 (see FIGS. 4 and 5).

The base 14 includes two sets of cover locks. A first or upper set of cover locks 42 is configured to receive and secure the cover 16 in a first opened position. The second or lower set of locks 44 is configured to secure the cover 16 in a locked or closed position. As best seen in FIG. 1, a pair of upper locks 42 are formed on each of the opposing side walls 24, 26 and a pair of lower locks 44 are formed on each of the opposing side walls 24, 26, as well as the front and rear walls 20, 22. It will be readily recognized by those skilled in the art that when in the closed position, it is desired to assure the greatest "locking" of the cover 16 to the base 14.

Figure 4:
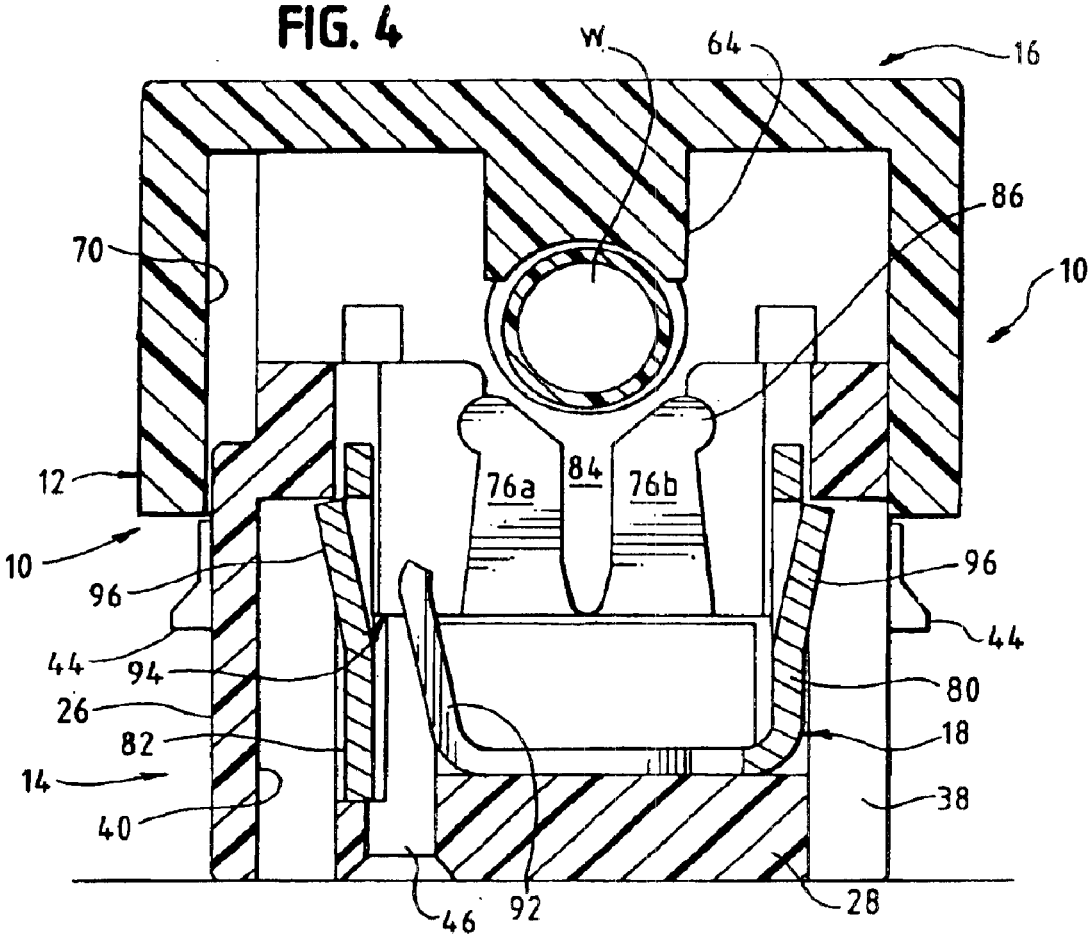
FIG. 4 is a cross-sectional view taken essentially along line 4—4 or FIG. 1, the connector being shown with the cover in a first, receiving position and a wire positioned therein.
Figure 5:
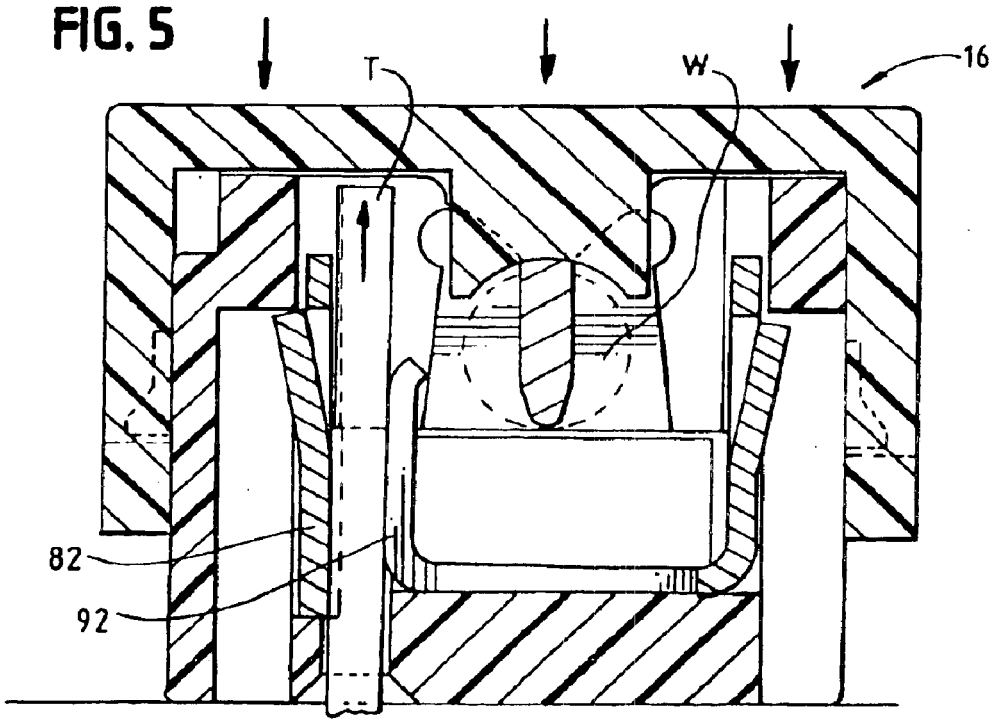
FIG. 5 is a cross-sectional view similar to FIG. 4 with the cover moved into a second, locking position and showing the wire secured in the electrical contact.

As best seen in FIGS. 4 and 5, the base bottom wall 28 includes a slot or opening 46 (adjacent the side wall channel 40) that is configured for receiving the motor tab T. The bottom wall slot 46 is formed so as to align the tab T with the contact 18, as will be discussed below. The slot 46 is formed inwardly of the side wall 26 to which it is adjacent.

The cover 16 includes a front wall 48 having an opening 50 therein, a pair of partially formed side walls 52, 54, pillars 56, 58 at about a juncture of the cover rear and sidewalls 52, 54 and a top wall 60. The pillars 56, 58 provide structural support as well as alignment of the cover 16 on the base 14 when inserting and connecting a wire W in the connector 10. A wire stop and plunger portion 62 depends from the top wall 60 between the pillars 56, 58 and opposite the front wall 48. An anvil portion 64 is formed in the top wall 60 (in the interior of the cover 16). The anvil 64 is longitudinally aligned with the wire stop and plunger 62 and front wall opening 50.

As provided above, the sidewalls 52, 54 are partially formed. Each sidewall 52, 54 includes a central portion 66 depending from the top wall 60. Arms 68 extend outwardly from about a bottom or free end of the central wall portion 66. The outwardly extending arms 68 are configured for engagement with the upper and lower cover locks 42, 44 (on the base 14) for securing the cover 16 on the base 14 in the opened and closed positions.

Figure 2:
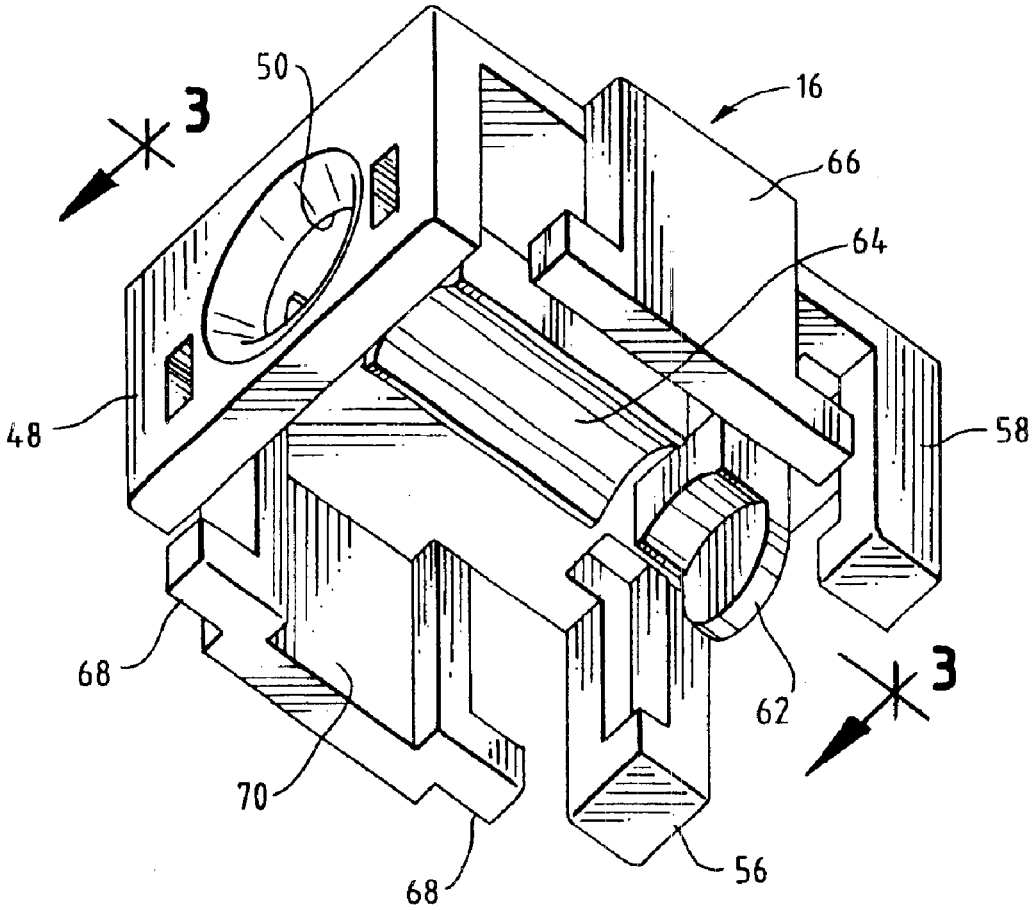
FIG. 2 is a bottom perspective view of the housing cover of FIG. 1.
Figure 3:
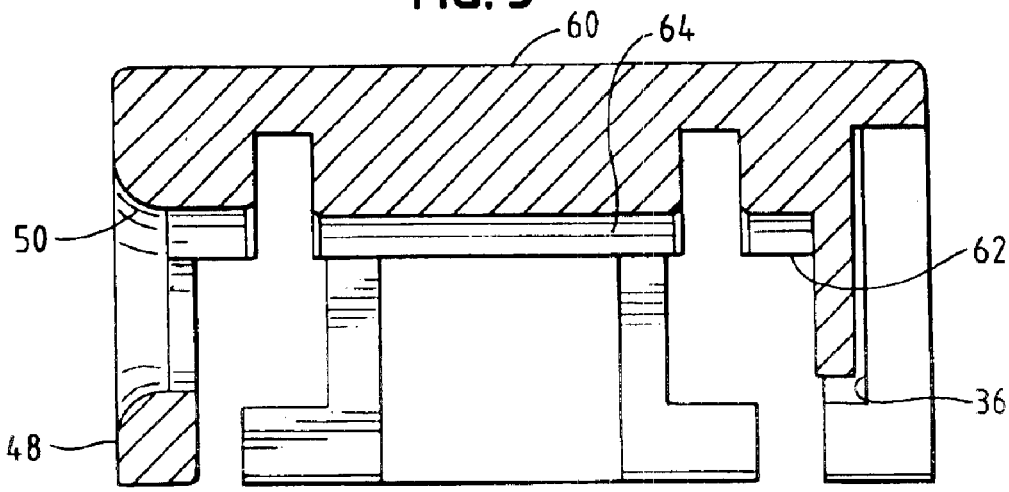
FIG. 3 is a cross-sectional view taken along line 3—3 or FIG. 2.

One of the sidewalls 54, as best seen in FIGS. 2 and 4–5 extends outwardly, as indicated at 69, and defines a recessed region 70 at about that area of the base 14 configured for receiving the motor tab T. The recessed region 70 is configured to accommodate the base channeled side wall 40, while the outward extension 69 is configured to strengthen the overall assembly around the housing side wall channel 40, where the motor tab T is received.

The contact 18 is best seen in FIG. 1. The contact 18 includes front and rear walls 72, 74 having upstanding fingers 76*a,b* and 78*a,b*, respectively, and a pair of side walls 80, 82. A slot, as indicated at 84, is defined between each pair of fingers 76*a,b* and 78*a,b* (that is, between finger 76*a* and finger 76*b* and between finger 78*a* and finger 78*b*) for receiving the conductor or wire W. The front fingers 76*a,b* each include an outwardly extending projection 86. The projections 86 are configured to engage or abut the housing base front wall 20 in the event that the wire W is "pulled" from connector 10. In this arrangement, in the event that the wire is pulled or over-tensioned (outwardly from the connector 10), the projections 86 engage the front wall 20, adjacent the notch 32, which prevents the front fingers 76*a,b* from being pulled through the notch 32.

The contact 18 includes a spring leg 88 that is configured to engage the motor tab T. The spring leg 88 is formed as a biased element extending inwardly from one of the contact side walls 80 across the contact 18 toward the opposing side wall 82. As such, the spring leg 88 includes a lateral portion 90 (extending across the contact) and an upwardly inclined portion 92 spaced from the contact side wall 82. In this manner, the spring leg 88 is formed having a bias toward the motor tab T to maintain contact with the tab T when the tab T is positioned between the side wall 82 and the spring leg 88. A gap 94 is defined between the inclined portion of the spring leg 88 and the side wall 82.

In a current embodiment, the contact 18 includes a pair of spring legs 88 to provide redundancy so that at least one leg 88 will remain functional, providing electrical contact with the motor tab T in the event that the other leg becomes non-functional, e.g., becomes bent.

Each of the contact sidewalls 80, 82 includes an outwardly extending lock or detent member 96 formed therein. The detent members 96, like the contact spring legs 88 are biased by their connection to the contact 18 body and by their configuration, i.e., "bent" formation.

Referring now to FIGS. 4–5 (and with brief reference to FIG. 2) the overall assembly and use of the connector 10 will be described. Referring first to FIG. 4, the contact 18 is positioned within the housing base 14. The contact 18 is positioned within the base 14 so that the contact detents 96 extend into the slotted region 38 of sidewall 24 and into the channeled region 40 of side wall 26. This secures the contact 18 within the housing base 14. As positioned within the base 14, the contact spring legs 88 overlie, in part, the base bottom wall slot 46 and extend upwardly from about one of the surfaces 98 that define the bottom wall slot 46. The opposing sidewall of the contact 52 overlies, in part, the slot 46 and extends upwardly from about the opposing surface 99 of the bottom wall slot 46. In this configuration, the gap 94 between the spring leg 88 and the side wall 52 overlies the bottom wall slot 46.

The cover 16 is fitted onto the base 14 in the opened position. In this position, the arms 68 of the sidewalls 52, 54 are engaged with (i.e., below) the base upper cover locks 42, and are positioned above the base lower cover locks 44 (i.e., the arms 68 are positioned between the upper and lower locks 42, 44). Thus, the connector 10 is provided as a single or unitary member that is configured for quickly and readily receiving a wire W.

As shown in FIG. 4, a wire W is inserted into the cover opening 50 and is urged all the way through the connector 10 until the wire W contacts the wire stop 62. In this position, the wire W is ready to be connected to the connector 10. Referring now to FIG. 5, the cover 16 is urged or pushed downwardly. As the cover 16 is urged downwardly, the anvil 64 and stop plunger portion 62 push the entirety of the wire W into the slot 84 between the contact fingers 76*a,b* and 78*a,b*. As set forth above, the anvil 64 and plunger portion 62 extend substantially along the length of the cover 16, except for those regions immediately above the contact fingers 76*a,b* and 78*a,b*. This provides a generally consistent force that is exerted downwardly onto the wire W to urge the wire W into contact with the fingers 76*a,b* and 78*a,b*.

When the cover 16 is pushed fully downwardly onto the base 14, the cover side wall arms 68 engage the base sidewall lower cover locks 44 and the front and rear wall lower cover locks 44 engage the cover front wall 48 and rear pillars 56, 58 to secure the cover 16 on the base 14. In this manner, the wire W is secured in the contact fingers 76*a,b* and 78*a,b* and the cover 16 is secured onto the base 14 to provide the readily assembled connector 10 and wire W assembly. As set forth above, the projections 86 prevent inadvertently "pulling" the wire W from the connector 10, by engaging the front wall 20 (if the wire W is pulled) and in turn, preventing the fingers 76*a,b* from being pulled through the notch 32.

Referring now to FIG. 5, again, to connect the wired connector 10 to the motor tab T, it is necessary only to insert the motor tab T into the connector base slot 46. This urges the motor tab T into the gap 94 between the contact spring legs 88 and the contact side wall 82, thus providing a secure electrical connection between the wire W and the motor tab T, via the connector contact 18.

Figure 6:
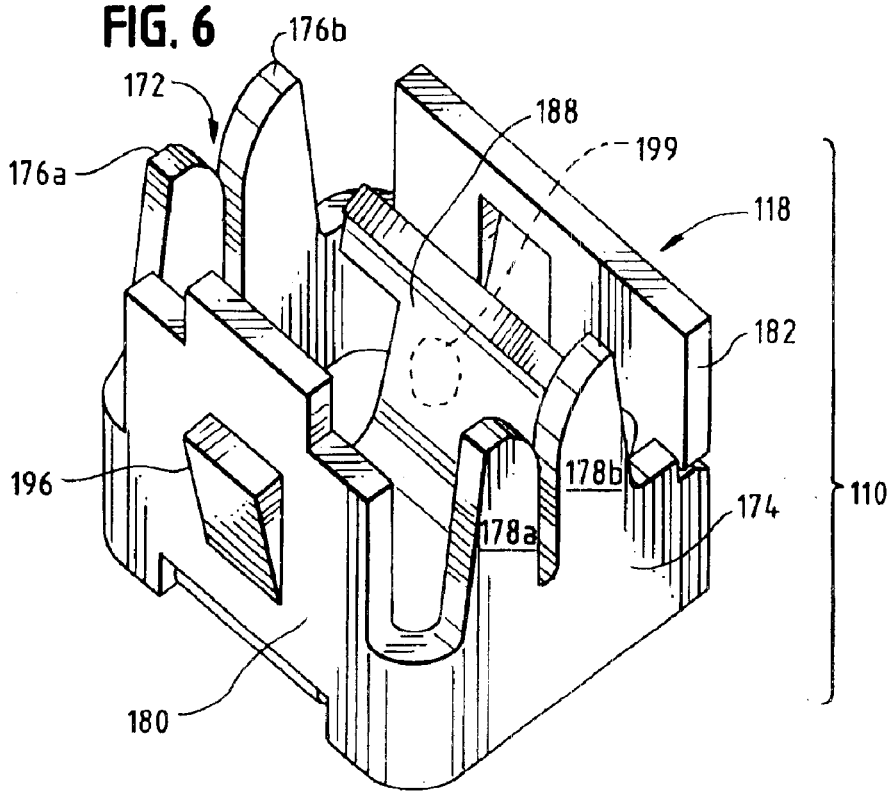
FIG. 6 is a perspective view of a contact for use with an alternate embodiment of the electrical tab connector.
Figure 7:
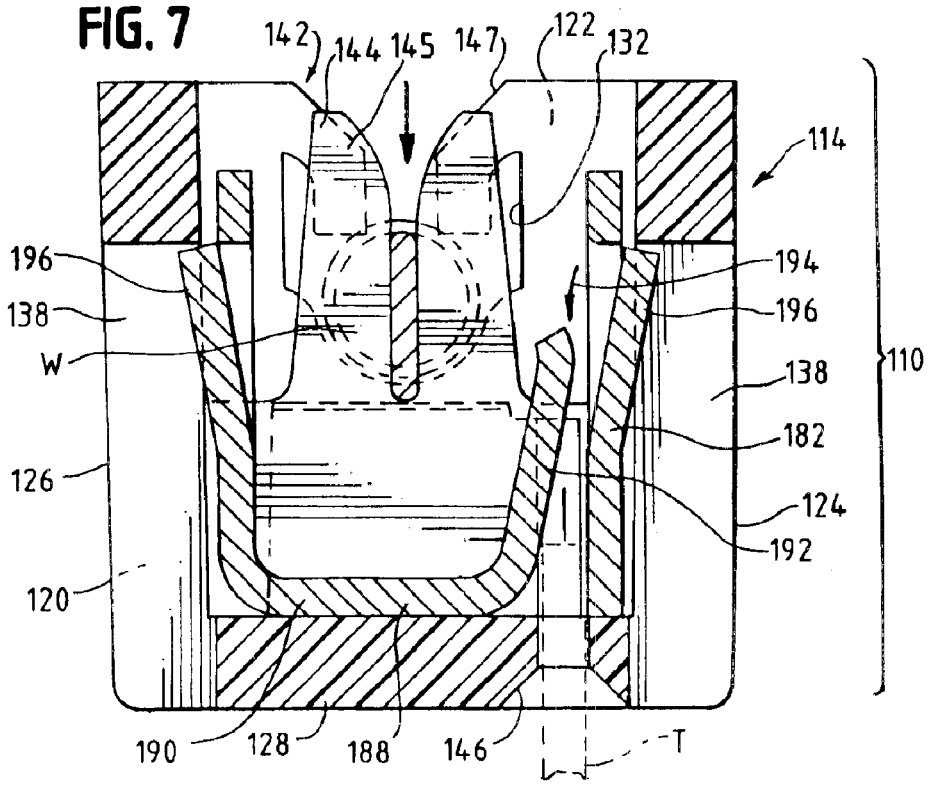
FIG. 7 is a cross-sectional view of the alternate embodiment of the connector shown with the contact position within the housing and with a wire positioned within the connector.

With reference now to FIGS. 6 and 7, there is shown an alternate embodiment of the connector 110. This connector 110 is a "coverless" type of connector in that it is formed of only a housing base 114 and a contact 118. The housing base 114 includes a pair of opposing sidewalls 124, 126, a front wall 120 and a rear wall 122. The base 114 further includes a bottom wall 128 having a slot 146 therein. The base sidewalls 124, 126 include slots 138 for receiving locks 196 from the contact 118. In this embodiment, the front wall notch 132 can include retaining fingers 142 at an upper region of the slot 132. The retaining fingers 142 can be formed including an inwardly extending portion 144 and a downwardly extending portion 145. An entrance 147 is formed at the juncture of the inwardly and downwardly extending portions 145, 147 to facilitate urging the wire W into the connector 110. The retaining fingers 142 help to retain the wire W in the connector 110 once it is fully inserted therein.

FIG. 6 illustrates a contact 118 for use with the alternate housing base 114 embodiment. The contact 118 includes front and rear walls 172, 174 and opposing sidewalls 180, 182. Upwardly extending fingers 176*a,b* and 178*a,b* on the front and rear walls 172, 174 provide electrical contact for the wires W. Similar to the first embodiment 10, the sidewalls 180, 182 include the outwardly extending detents or locks 196 that are configured for receipt in the housing base slots 138 and channel 140.

Also similar to the first embodiment 10, this embodiment of the contact 118 includes a spring leg 188 that is configured to engage the motor tab T. The spring leg 188 is formed as a biased element extending inwardly from one of the contact side walls 180 across the contact 118 toward the opposing side wall 182. The spring leg 188 thus includes a lateral portion 190 and an upwardly inclined portion 192 spaced from the contact side wall 182. The spring leg 188 is formed having a bias toward the motor tab T to maintain contact with the tab T when the tab T is positioned in the gap 194 between the side wall 182 and the spring leg 188.

As shown in FIG. 7, a wire W is readily inserted between the fingers 176*a,b* and 178*a,b* for securing the wire W to the contact 118 and thus to the connector 110. Again, to connect the connector 110 to a motor tab T, it is necessary only to insert the motor tab T into the base bottom wall slot 146 which urges the tab T into contact with the contact spring leg 188 and opposing sidewall 182, thus providing electrical connection between the wire W and the motor tab T.

In both of the embodiments of the connector 10, 110, their respective contacts 18, 118 can be formed having a single spring leg 188 (as illustrated in FIG. 6) or multiple spring legs 88 (as illustrated in FIG. 1 which show two spring legs). As set forth above, and as will be recognized by those skilled in the art, motor tabs T are often formed with openings O for receiving wires. In the configuration having a single spring leg 188, referring to FIG. 6, the leg 188 can be formed having a dimple 199 to engage the motor tab openings O to provide enhanced locking of the contact 118 (and thus the connector 110) to the motor tab T.

It will be appreciated that the because of the configuration and the angular connection of the wire W to the motor tab T provided by the connector 10, 110 the connector 10, 110 permits attaching the wire W to the tab T at an angle. This has numerous advantages, one of which is space-savings in the equipment in which the motor M is installed. Additionally, the angled attachment provides flexibility in mounting or routing wires in the equipment.

Those skilled in the art will recognize that all of the components discussed above are quite small. For example, the exemplary connectors 10, 110 may have dimensions of less than about ¼"×¼"×¼". As such, handling of individual connectors 10, 110 and contacts 18, 118 can be difficult, time consuming and labor intensive.

Figure 8:
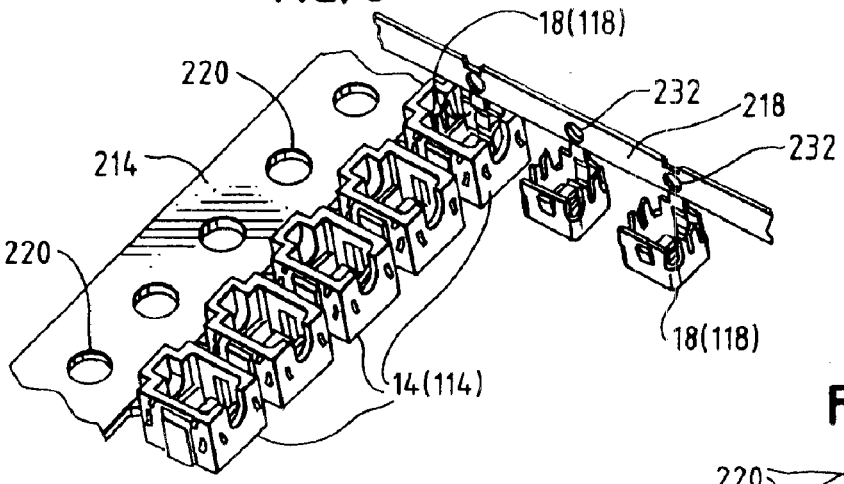
FIG. 8 is a perspective view of one embodiment of a strip or carrier having a plurality of housing bases formed thereon.
Figure 9:
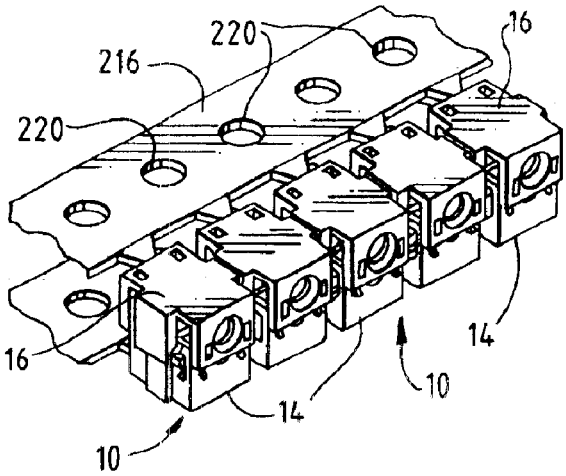
FIG. 9 is perspective view of one embodiment of a strip or carrier having a plurality of contacts formed thereon.
Figure 10:
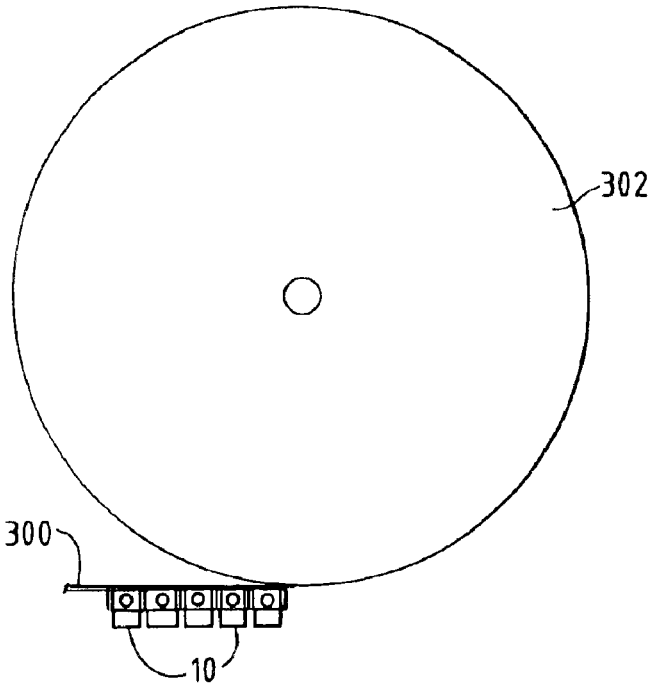
FIG. 10 is an alternate embodiment of the carrier of FIG. 8, the carrier having raised locating pins formed therein.

Referring now to FIGS. 8–10, a novel method for forming and fabricating the connectors 10, 110 includes forming a plurality of housing bases 14, 114 on a base carrier or strip 214 and forming a plurality of contacts 18, 118 on a contact carrier or strip 218. The carriers or strips 214, 218 are then aligned relative to one another to position the contacts 18, 118 over and within their respective bases 14, 114. Housing covers 16 can likewise be formed on a cover carrier or strip 216 and mounted to their respective bases 14 (with the contacts 18 already mounted in their respective bases 14) and secured in the opened position. The connectors can then be positioned on a strip, such as an adhesive tape strip 300 (see FIG. 10) and wound onto a reel or spool 302 for subsequent dispensing.

In a preferred method, the base strip 214 and cover strip 216 are each formed in accordance with known injection molding techniques. The strips 214, 216 can include aligning markers, such as the exemplary locating openings 220 to facilitate indexing, locating or aligning the bases 14, 114 with their respective contacts 18, 118 and to facilitate indexing, locating or aligning the covers 16 (again, if used) with their respective bases 14.

To form a large number of connectors 10, the strips 214, 216 can be molded in a discrete size (e.g., a strip section) having connecting regions (not shown) that can then be positioned at one end of the mold, onto which a next subsequent strip section can be molded. In this manner, shorter strip sections can be connected together to form an elongated or continuous strip having many housing sections formed thereon.

In the contemplated method, the contacts 18, 118 are likewise formed on a carrier or strip 218 in, for example, a known punch and die method. Blanks can be cut for the overall footprint of the contacts 18, 118, which can then be formed in subsequent forming (e.g., bending and/or cutting) operations. The contacts 18, 118 are formed along the strip 218, and the strip 218 can be formed with aligning markers, such as openings 232 to facilitate aligning and indexing the contact strip relative to the housing base strip 214. As seen in FIG. 8, the individual contacts 18 are then positioned in their respective bases 14, and the contacts 18 separated from the carrier strip 218. Referring to FIG. 9, covers 16 can then be positioned on the bases 14, if desired. The connectors 10 can then be mounted to a strip, such as the illustrated, exemplary adhesive strip 300 (FIG. 10), and wound onto a reel or spool 302, again if desired, for dispensing.

Those skilled in the art will recognize the various configurations that can be used to form the housing portion and contact carriers, and the various methods and corresponding structure that can be used to locate or align the respective carriers with one another, which other structures and methods are within the scope and spirit of the present invention. For example, it is contemplated that human and/or machine readable markings or indicia can be used to locate and align the housing portions (e.g., carriers) and the contacts (e.g., carriers) with one another for ready fabrication of the connectors.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A connector for connecting an associated electrical component having a tab-type electrical terminal to an associated conductor, comprising:

a non-conducting housing base having a bottom wall, an upstanding front wall and upstanding, opposing side walls generally transverse to the front wall, the housing base defining a well, the front wall having a notch formed therein for receiving the associated conductor, the bottom wall having an opening therein for receiving the tab-type electrical terminal; and a conductive contact carried by the housing base, disposed in the well, the contact having conductor receiving elements generally aligned with and on opposing sides of the notch in the housing front wall, the conductor receiving elements configured for receiving the conductor therebetween, the contact further including first and second terminal engaging portions defining a tab-receiving region therebetween, the contact carried by the housing base to dispose the tab-receiving region in overlying relation to said opening in the housing base bottom wall, wherein the tab-type terminal, inserted through the housing base bottom wall opening, is received in the contact tab-receiving region, and is in electrical contact with the conductor positioned between the conductor receiving elements, the housing base being formed on a housing base carrier a first predetermined distance from a second housing base formed on the housing base carrier and the contact being formed on a contact earner a second predetermined distance from a second contact formed on the contact carrier.

2. The connector in accordance with claim 1 wherein the tab-receiving region is defined by a biased spring leg and a side wall of the contact.

3. The connector in accordance with claim 2 wherein the biased spring leg and the side wall of the contact define a gap therebetween.

4. The connector in accordance with claim 3 wherein the gap overlies the opening defined in the housing base bottom wall.

5. The connector in accordance with claim 1 including a cover configured to fit onto the housing base.

6. The connector in accordance with claim 5 wherein the cover and housing base are configured for fitting onto one another in a first opened position and a second closed position.

7. The connector in accordance with claim 6 wherein the cover is configured to receive the associated conductor in the opened position and wherein the cover is configured to urge the conductor between the conductor receiving elements in the closed position.

8. The connector in accordance with claim 7 wherein the cover includes an anvil portion for urging the conductor between the conductor receiving elements when the cover is in the second position.

9. The connector in accordance with claim 1 wherein the housing base front wall includes retaining fingers disposed on opposing sides of the notch for retaining the conductor in the connector when the conductor is positioned between the conductor receiving elements.

10. A connector for connecting an associated electrical component having a tab-type electrical terminal to an associated conductor, comprising:

a non-conducting housing base having a bottom wall, an upstanding front wall and upstanding, opposing side walls generally transverse to the front wall, the housing base defining a well, the front wall having a notch formed therein for receiving the associated conductor, the bottom wall having an opening therein for receiving the tab-type electrical terminal, the housing base being formed on a housing base carrier a first predetermined distance from a second housing base formed on the housing base carrier; and a conductive contact carried by housing base, disposed in the well, the contact including means for receiving and retaining the conductor in engagement with the contact and means for receiving and retaining the component terminal, to provide electrical contact of the conductor and the component terminal, the contact being formed on a contact carrier a second predetermined distance from a second contact formed on the contact carrier.

11. The connector in accordance with claim 10 wherein the means for receiving and retaining the component terminal is a biased element.

12. The connector in accordance with claim 10 wherein the biased element is a spring leg.

13. The connector in accordance with claim 12 wherein the biased element is a plurality of spring legs.

14. A method for making a connector for connecting an associated electrical component having a tab-type electrical terminal to an associated conductor, comprising the steps of:

forming a plurality of connector housing bases on a housing base carrier, each of the connector housing bases being a first predetermined distance from each adjacent housing base;

forming a plurality of contacts on a contact carrier, each of the contacts being a second predetermined distance from each adjacent contact;

forming a plurality of connector housing covers on a cover base carrier, each of the connector housing covers being a first predetermined distance from each of its adjacent housing covers;

aligning a first of the plurality of contacts with a first of the plurality of housing bases;

aligning a first of the plurality of connector housing covers with a first of the plurality of housing bases;

securing the first of the plurality of contacts in the first of the housing bases with which the first of the plurality of contacts is aligned; and securing the first of the plurality of housing covers to the first of the housing bases with which the first of the plurality of housing covers is aligned.

15. The method in accordance with claim 14 including the steps of indexing the housing base carrier and indexing the housing cover carrier to align a second of the plurality of housing base covers with a second of the plurality housing bases and securing the second of the plurality of housing base covers on the second of the housing bases with which the second of the plurality of housing base covers is aligned.

* * * * *